US005537805A

United States Patent [19]

Allman

[11] Patent Number: 5,537,805

[45] Date of Patent: Jul. 23, 1996

[54] APPARATUS AND METHOD FOR CONSTRUCTING A MASONRY HEADER

[76] Inventor: James W. Allman, 206 Hillside Dr., Zelienople, Pa. 16063

[21] Appl. No.: 425,873

[22] Filed: Apr. 20, 1995

[51] Int. Cl.[6] ..... E04G 21/14

[52] U.S. Cl. ..... 52/749.13; 52/749.15; 52/85; 33/518

[58] Field of Search ..... 52/749.13, 749.15, 52/85, 127.2, 88, 89; 33/518, 563, 408, 410; 248/295.11, 231.9, 354.3

[56] References Cited

U.S. PATENT DOCUMENTS

| | | | |
|---|---|---|---|
| 223,372 | 1/1880 | Miner | 33/518 |
| 1,076,270 | 10/1913 | Schuffenhaver | 52/749.15 X |
| 2,286,669 | 6/1942 | Corr | 33/408 |
| 2,543,716 | 2/1951 | Carini | 33/518 |
| 3,166,164 | 1/1965 | Daniels | 52/127.2 |
| 3,756,172 | 9/1973 | Brereton et al. | 52/749.15 X |
| 3,863,420 | 2/1975 | Peiffer et al. | 52/749.15 |
| 4,359,850 | 11/1982 | Sinkes | 52/749.13 X |
| 4,928,915 | 5/1990 | Havins | 248/295.11 X |
| 5,129,150 | 7/1992 | Sorensen | 33/408 |

FOREIGN PATENT DOCUMENTS

| | | | |
|---|---|---|---|
| 1429555 | 12/1968 | Germany | 248/295.11 |
| 3150461 | 7/1983 | Germany | 52/85 |
| 985227 | 12/1982 | U.S.S.R. | 52/85 |

*Primary Examiner*—Carl D. Friedman
*Assistant Examiner*—W. Glenn Edwards
*Attorney, Agent, or Firm*—Carothers & Carothers

[57] ABSTRACT

In constructing a masonry header, masonry header jacks are mounted in opposed fashion on the sides of existing spaced masonry stiles. A masonry header template is supported on the jacks between the stiles and the jacks are vertically adjustable for properly positioning the template prior to constructing a masonry header on top of the template. After the header is cured, the template and jacks are removed. The jacks include horizontally disposed base mounting arms that have a vertical thickness equivalent to the thickness of mortar joints in the stiles. The jacks are mounted on the stiles by positioning the arms in preselected mortar joints of the stiles when the masonry block or brick stiles are laid up.

5 Claims, 3 Drawing Sheets

APPARATUS AND METHOD FOR CONSTRUCTING A MASONRY HEADER

BACKGROUND OF THE INVENTION

This invention relates to support systems for patterns or templates used in determining the profile of a masonry arch or header. More particularly, the present invention pertains to vertically adjustable jacks which can be used to adjustably support a pattern or template defining the underside profile of a masonry arch or header spanning a passageway, window or the like, in order that the masonry header may be formed insitu on the temporarily supported pattern or template. The invention has particular application in the construction of brick or poured insitu arches or other headers formed above and spanning between brick or block vertical masonry stiles.

When constructing a brick arch, or other type masonry headers formed insitu, it is customary to produce a pattern or template manufactured of wood with the appropriate upper supporting contours for defining the underside profile of the header, and for supporting the header as it is formed on top of the pattern or template.

After the masonry header has been formed over top of the pattern or template, it is then permitted to cure and thereafter the wood template is removed leaving the masonry header, which was formally supported by the template.

The header pattern or template is temporarily supported on its opposite ends by upstanding stile supports. The stile supports are generally hand constructed of wood and extend all the way from the passageway or opening base or sill.

Such pattern or template end supports are expensive and time consuming and fine vertical adjustment of the support system to properly preposition the header template is time consuming and normally accomplished by the use of wood shims or the like.

It is also known that the temporary upstanding stile supports cannot always be reused due to the different sized openings or passageways encountered from one construction site to the next.

It is a principal object of the present invention to provide an apparatus and method which eliminates these aforesaid disadvantages.

SUMMARY OF THE INVENTION

In accordance with the teachings of the present invention, masonry header jacks are temporarily supported or mounted in opposed fashion on the sides of existing spaced masonry stiles. The header jacks are vertically adjustable and support the masonry header template or pattern between the stiles. The header jacks are then vertically adjusted as required for properly positioning the header template. The masonry header spanning the stiles is then constructed on top of the template and allowed to cure. Thereafter the template and jacks are removed.

The masonry header may typically be constructed of brick or block or may be poured insitu.

The masonry stiles are constructed of vertical stacks of masonry block, such as brick, which is laid up with mortar joints therebetween. The jacks are provided with horizontally disposed base mounting arms that have a vertical thickness equivalent to the thickness of these mortar joints. The jack is mounted on the masonry stiles by positioning this arm in a preselected mortar joint of the stiles when laying up the blocks for the stiles. After the template and jacks have been removed, these mortar joints left empty by the jacks are then pointed with mortar.

The template jacks generally consist of a jack base adapted for temporary securement on the side of a masonry stile and a vertically moveable jack mechanism that is mounted on the base for temporarily and adjustably supporting the horizontally disposed masonry header template. The jack base is preferably constructed in the form of an inverted L with a vertical arm for resting against a masonry stile and a horizontal arm that is adapted to be received temporarily in a masonry mortar joint of one of the stiles. The jack mechanism may be vertically adjusted to properly position the supported header pattern or template by hand manipulation, such as hand manipulation of a conventional jack screw. Other types of vertically adjustable jack mechanisms are acceptable.

The horizontal arm of the jack base is also preferably provided with a central end slot for receiving joint mortar. Thus when the jack is removed after use, a larger area of joint mortar support exists between the two bricks or blocks from between which the jack horizontal base arm was removed. This space left by the jack base arm is then simply filled by pointing the space with mortar.

The apparatus and method of the present invention is equally applicable to arched or straight masonry headers.

BRIEF DESCRIPTION OF THE DRAWINGS

Other objects and advantages appear hereinafter in the following description and claims. The invention will now be described by way of example only and without limiting the invention thereto, by way of reference to the accompanying drawings wherein:

DESCRIPTION OF THE PREFERRED EMBODIMENTS

Figure 1:
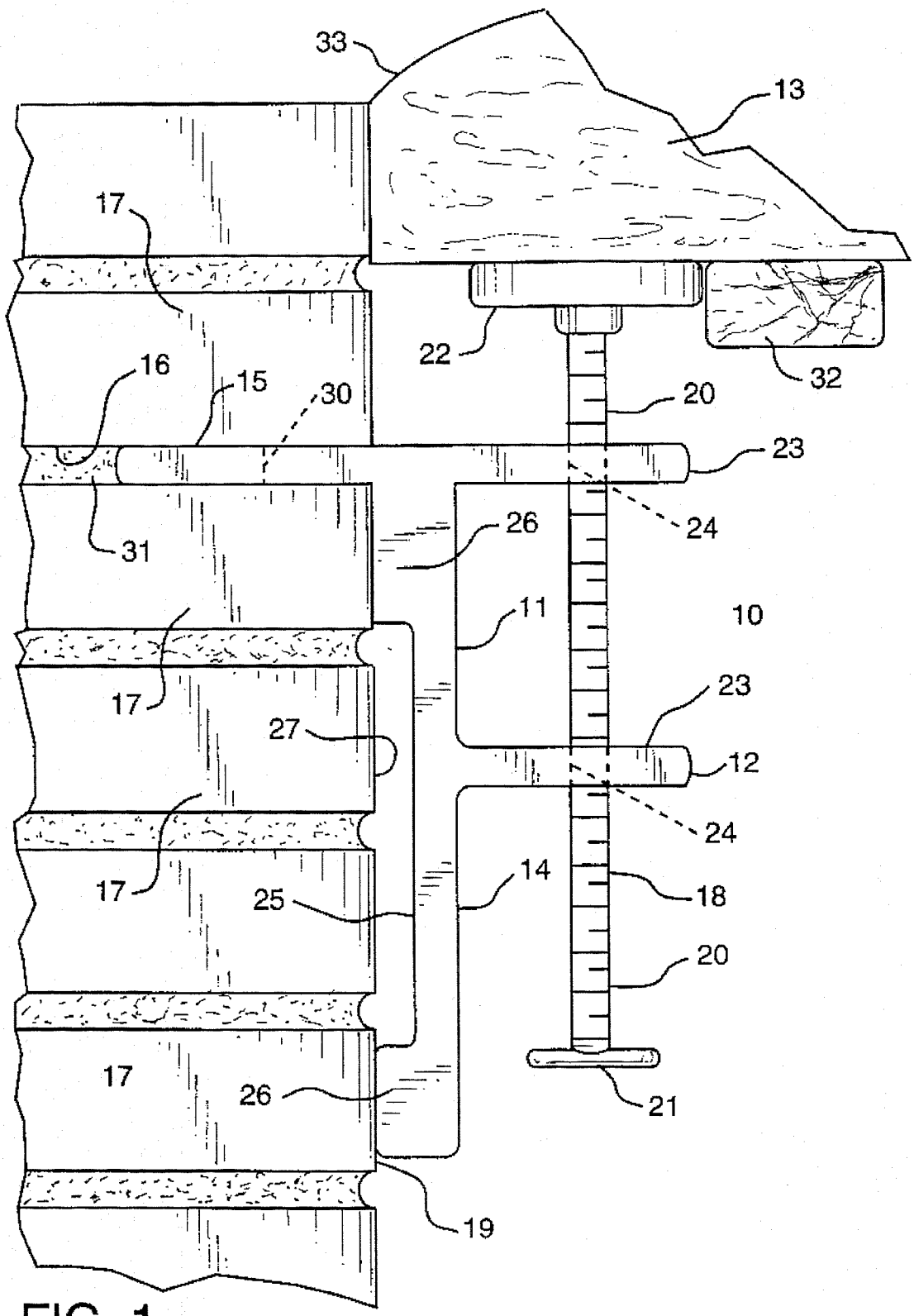
FIG. 1 is a view in side elevation of one embodiment of the masonry template jack of the present invention supporting one end of a masonry template.
Figure 2:
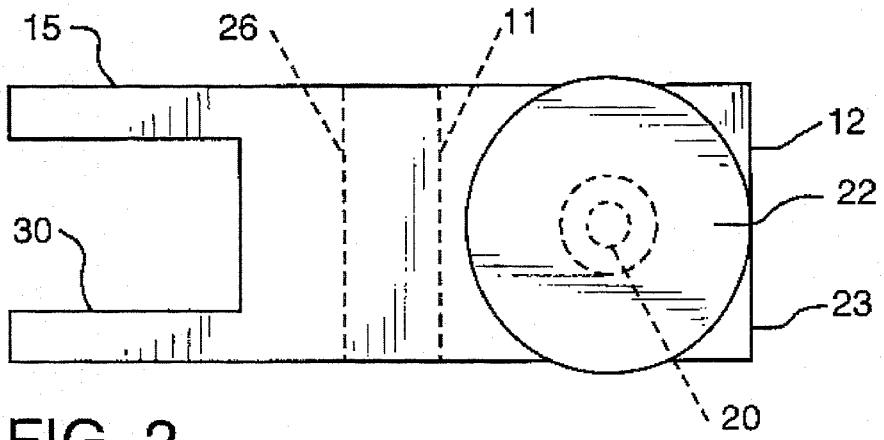
FIG. 2 is a top or plan view of the masonry jack illustrated in FIG. 1 with the template and masonry removed the full disclosure.
Figure 3:
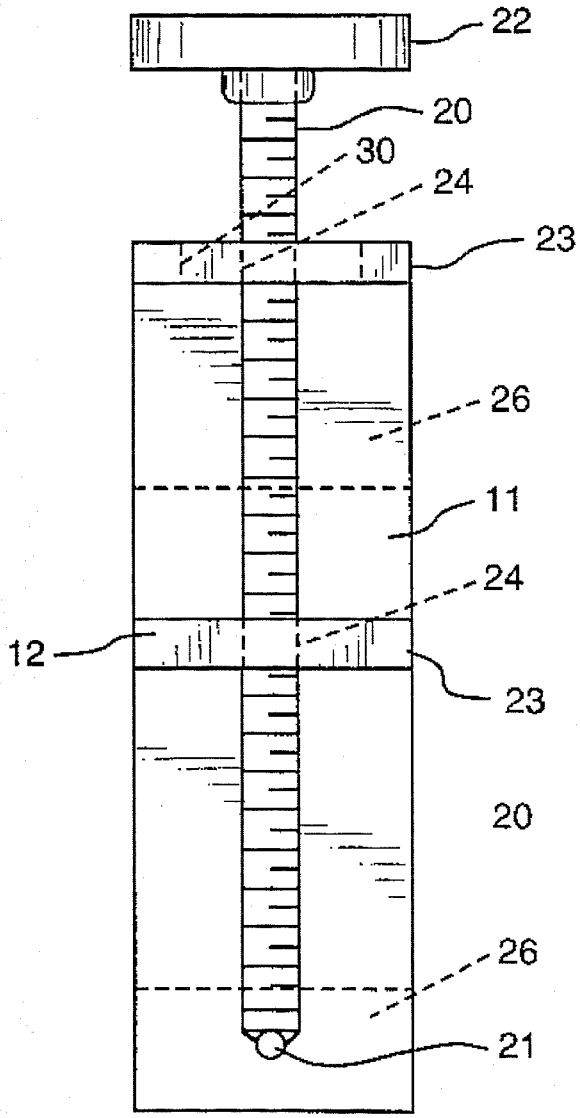
FIG. 3 is a view in front elevation of the template jack shown in FIG. 1 with the template and masonry removed.

Referring to the drawings, and with particular reference first to FIGS. 1 through 3, the adjustable masonry header template jack 10 of the present invention includes a masonry jack base 11 having a vertically moveable jack mechanism 12 mounted on the base 11. The moveable jack mechanism 12 is adapted for temporarily and adjustably supporting portions of the horizontally disposed masonry header pattern or template 13.

The jack base 11 is in the configuration of an inverted L with the vertical arm portion 14 thereof resting against a vertical masonry stile 19 and horizontal arm portion 15 thereof received temporarily in masonry mortar joint 16. Arm 15 is of the same vertical thickness as mortar joint 16 to provide equivalent support between the bricks 17.

The vertical jacking mechanism 12 includes a hand manipulatable jack screw 18 which is constructed of an elongated screw shaft 20, made of all-thread which has a T-handle 21 welded to the bottom end thereof and a support foot or pad 22 threadibly received on the upper end.

The threaded shaft 20 is threadibly received through jack support ears 23 at threaded passages 24. Accordingly, vertical jack mechanism 12 may be vertically adjusted by rotating handle 21 to correspondingly raise or lower support pad or foot 22, thereby permitting the end of template 13 to be appropriately adjusted relative to the vertical side stile 19.

The vertical arm 14 of jack base 11 is further provided with a vertical relief space 25 between top and bottom abutment pads 26 to accommodate any roughened brick surfaces 27 which might possibly exist on the exposed ends of bricks 17.

Horizontal arm 15 of jack base 11 is provided with a central end slot 30 for receiving more or extra joint mortar 31.

Figure 4:
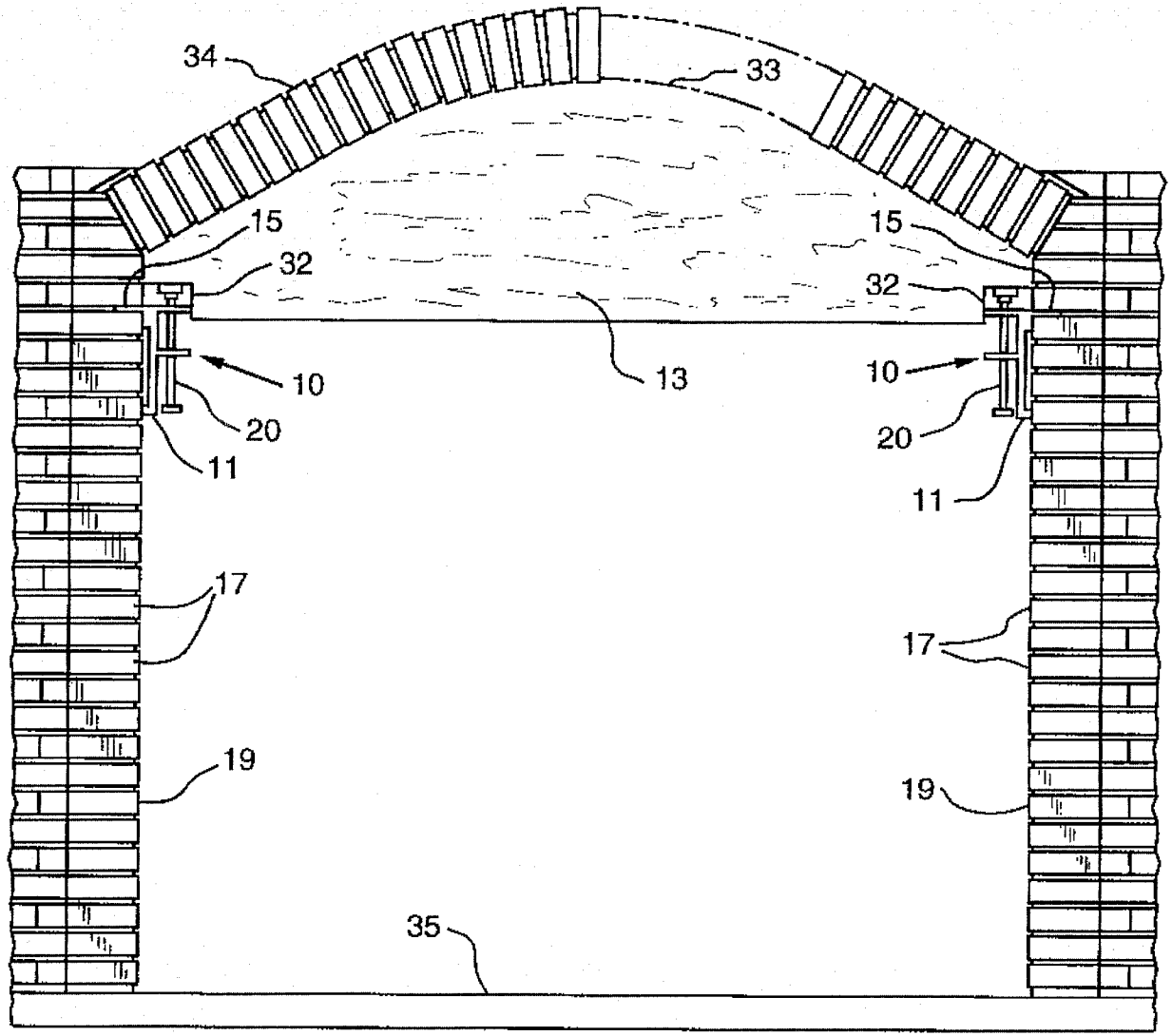
FIG. 4 is a view in elevation of a masonry window passageway or opening showing the masonry header jacks of FIGS. 1 through 3 supporting a masonry header template between vertical brick side stiles.

As is better illustrated in FIG. 4, two jacks 10 are mounted in opposed fashion on spaced masonry stiles 19 thereby supporting opposite ends of masonry header template 13 therebetween.

Basically, the only difference in detail between FIG. 1 and FIG. 4 is that in FIG. 1 a jack kick-out prevention stop 32 is provided by a two-by-four which is nailed or screwed to the underside of the end of template 13. In FIG. 4, the kick-out abutment or stop 32 is provided by a notch or recess, as illustrated, cut into each end of the horizontal template 13 to receive the foot 22 of jacks 10. Stops 32 prevent jacks 10 from dislodging or otherwise slipping inwardly off of stiles 19.

The header template 13 is provided with an arched upper template surface 33 for constructing a masonry arch 34 thereon as best illustrated in FIG. 4.

With particular reference to FIG. 4, masonry header 34 is constructed by first temporarily mounting the vertically adjustable masonry header jacks 10 as previously described in opposed fashion, and as shown, on the sides of existing spaced masonry stiles 19. Masonry stiles 19 are constructed of laid-up brick 17 supported from underlying base or window sill 35. Jacks 10 support opposite ends of masonry header template 13 between stiles 19. If the header 13 is of considerable thickness, two or more jacks 10 may be utilized at opposite ends of template 13 for supporting the ends of template 13 in spaced fashion.

Jacks 10 are vertically adjusted as required for properly positioning or repositioning template 13 and then masonry header 34 is laid-up with mortar on template surface 33. Thereafter the masonry header 34 is permitted to cure (the mortar joints are permitted to cure), and the template 13 and jacks 10 are removed. The remaining mortar joint openings left by the absence of jack base arms 15 are then pointed with mortar.

The jack base 11, together with its integral ears 23, may be constructed of welded steel parts, cast of any appropriate metal, or extruded of aluminum.

I claim:

1. An adjustable masonry header template jack comprising: a masonry jack base adapted for temporary securement on the side of a masonry stile, and vertically movable jack means mounted on said base for temporarily and adjustably supporting portions of a horizontally disposed masonry header template;

said jack base is in the configuration of an inverted L with a vertical arm for resting against a masonry stile and a horizontal arm adapted to be received temporarily in a masonry mortar joint; said horizontal arm having a central end slot for receiving mortar.

2. The adjustable masonry header template jack of claim 1 wherein said jack means includes a hand manipulatable jack screw.

3. The adjustable masonry header template jack of claim 1 including two of said jacks mounted in opposed fashion on spaced masonry stiles and supporting opposite ends of a masonry header template therebetween.

4. The adjustable masonry header template jack of claim 3 wherein said header template has an arched upper template surface for constructing a masonry arch thereon.

5. The adjustable masonry header template jack of claim 3, including kick-out recess stops on an underside of said template at said opposite ends, said recess stops receiving a portion said jacks therein and adapted for preventing said jacks from accidentally dislodging from said stiles.

* * * * *